US008651544B2

(12) United States Patent
Bruce

(10) Patent No.: US 8,651,544 B2
(45) Date of Patent: Feb. 18, 2014

(54) CRUSHER JAW LINER TOOL

(76) Inventor: Thomas Bruce, East Doncaster (AU)

( * ) Notice: Subject to any disclaimer, the term of this patent is extended or adjusted under 35 U.S.C. 154(b) by 125 days.

(21) Appl. No.: 13/100,792

(22) Filed: May 4, 2011

(65) Prior Publication Data

US 2011/0297774 A1 Dec. 8, 2011

(30) Foreign Application Priority Data

May 5, 2010 (ZA) ..... 2010/03146

(51) Int. Cl.
*B66F 19/00* (2006.01)

(52) U.S. Cl.
USPC ..... 294/215; 294/89; 294/82.1

(58) Field of Classification Search
USPC ..... 294/92, 215, 89, 82.1, 62, 63.1, 74; 52/125.4; 241/285.1
See application file for complete search history.

(56) References Cited

U.S. PATENT DOCUMENTS

| | | | | | |
|---|---|---|---|---|---|
| 1,097,813 | A * | 5/1914 | Martin | 294/82.1 |
| 2,097,683 | A * | 11/1937 | Armstrong | 294/92 |
| 2,409,932 | A * | 10/1946 | Dostal | 294/15 |
| 2,676,053 | A * | 4/1954 | Brown | 294/92 |
| 2,968,510 | A * | 1/1961 | Ellis et al. | 294/62 |
| 3,499,676 | A * | 3/1970 | Haeussler | 294/90 |
| 4,088,361 | A * | 5/1978 | Ditcher | 294/89 |
| 4,561,199 | A * | 12/1985 | Lockwood | 37/403 |
| 4,925,226 | A * | 5/1990 | Leonard et al. | 294/82.1 |
| 5,596,846 | A * | 1/1997 | Kelly | 52/125.2 |
| 6,260,900 | B1 * | 7/2001 | Scott | 294/89 |
| 6,647,674 | B1 * | 11/2003 | Lancelot et al. | 52/125.4 |
| 7,111,432 | B2 * | 9/2006 | Hansort | 52/125.4 |
| 7,562,919 | B2 * | 7/2009 | Lawley | 294/215 |

* cited by examiner

*Primary Examiner* — Saul Rodriguez
*Assistant Examiner* — Gabriela Puig
(74) *Attorney, Agent, or Firm* — Matthew J. Lattig; Charter IP, LLC

(57) ABSTRACT

A jaw crusher liner handling tool includes a lifting eye having a radially extending shank and a radially extending lug, the lug including a hole parallel to the axis of the eye. The shank includes an elongate head on its end that is remote from the eye and is parallel to the axis of the eye.

4 Claims, 4 Drawing Sheets

CRUSHER JAW LINER TOOL

PRIORITY STATEMENT

This application claims the benefit under 35 U.S.C. §§119 a-d to South Africa Application Serial No. 2010/03146 to the inventor, filed May 5, 2010, the entire contents of which are hereby incorporated by reference herein.

BACKGROUND

1. Field

The example embodiment relates to a tool to facilitate the handling of liners for jaw rock crusher.

2. Related Art

The jaws of jaw rock crushers are lined with replaceable jaw liners to extend the useful life of the crusher. The jaw liners are heavy and difficult to handle while being removed from or installed into a crusher. Accordingly, what is needed is a tool which will facilitate these and other liner handling work.

SUMMARY

An example embodiment is directed to a jaw crusher liner handling tool comprising a lifting eye having a radially extending shank and a radially extending lug, the lug having a hole parallel to the axis of the eye and the shank having an elongate head on its end remote from the eye parallel to the axis of the eye.

In one example, the shank is curved in the plane of the eye away from the lug and the tool includes a bar threadable through the hole in the lug and a retaining clip.

In another example, a tool kit comprising a pair of tools as defined above further includes clips engageable on each end of the bar.

In a further example, the shank is curved towards its free end away from the lug, and the tool kit includes a closed lifting hook with flexible connecting members.

BRIEF DESCRIPTION OF THE DRAWINGS

These and other features of the example embodiment will become apparent from the following description thereof where reference is made to the accompanying drawings below.

DETAILED DESCRIPTION

Figure 1:
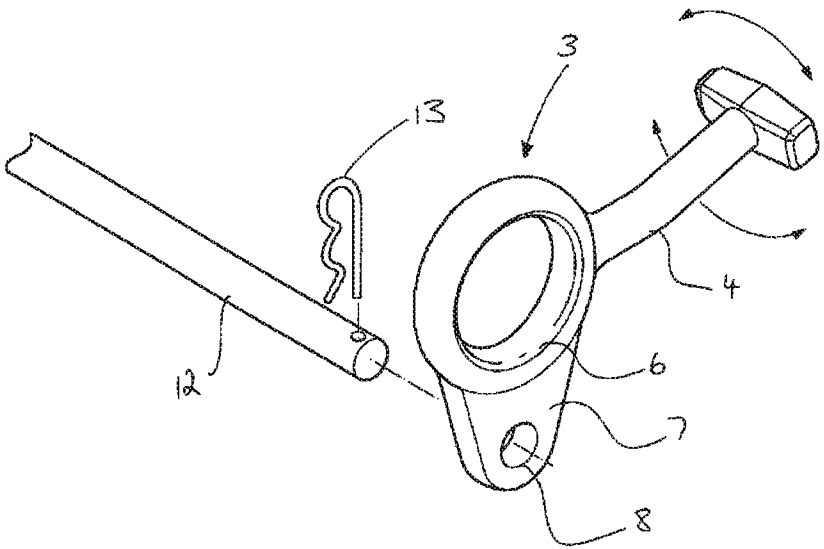
FIG. 1 shows part of the tool kit for a crusher jaw liner.
Figure 2:
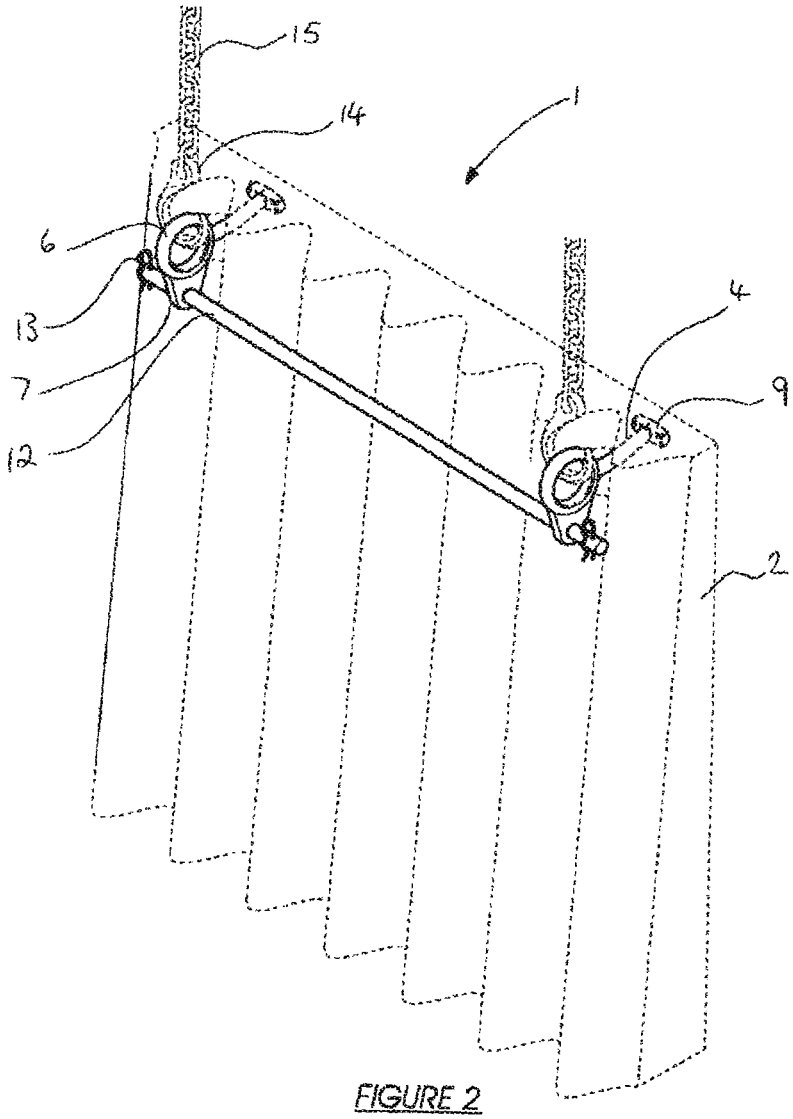
FIG. 2 shows the kit operatively engaged in the jaw liner.
Figure 3:
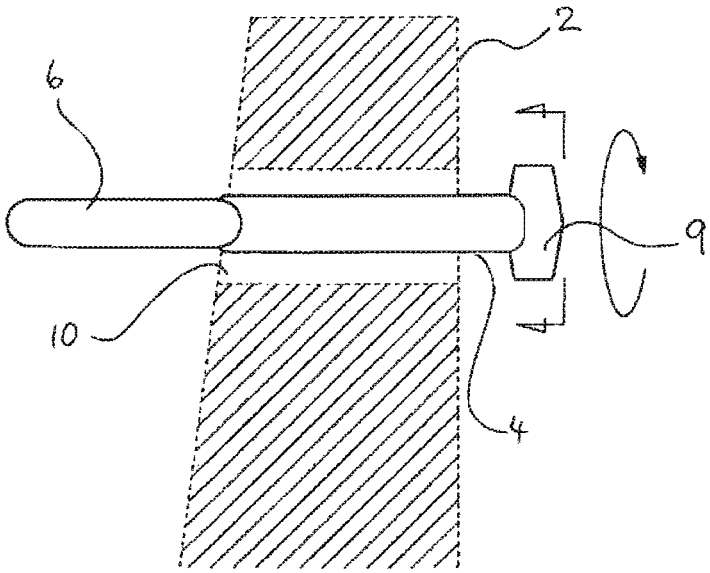
FIG. 3 shows a side view of one tool engaged in the jaw liner.
Figure 4:
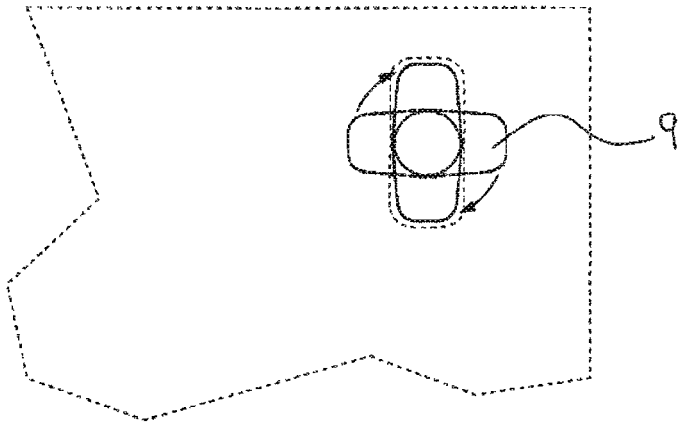
FIG. 4 shows a rear end view of the jaw liner with rotation of the head of the tool.

As illustrated a tool kit (1) is used to facilitate the handling of a crusher jaw liner (2) particularly during installation and removal of the liners from crusher jaws.

The kit consists of a pair of tools (3) each in the form of a shank (4) with a head (9) at one end extending transversely to the shank, and having an eye (6) at the other. A lug (7) having a hole (8) extends from the eye (6) in the same plane as that of the eye. The head (9) has a substantially rectangular shape. The shank (4) and lug (7) are coplanar. The head (9) extends transversely to the lug (7).

As illustrated, the jaw liners (2) have a corrugated crushing surface on one side and rectangular slots (10) are provided longitudinally through the bottoms of at least one pair of corrugations adjacent the operatively upper end (11) of the liner (2). The eyes (6) may be located in the respective corrugations with the lugs (7) projecting outwardly beyond the corrugations. This enables a stabilizing rigid bar (12) to be threaded through the holes (8) in the lugs (7). The bar (12) is retained in position by clips (13) fitted through the bar adjacent each end.

The tool (3) may be manipulated so that the head (9) passes through the slots only when the head (9) is aligned with a slot (10). When the stabilizer bar (12) is secured in position to the two holes (8) in the lugs (7), each head (9) is aligned at 90° to its respective slot (10), thus locking it against passing through the slot (10). Each tool can only be removed from the jaw liner (2) by disengaging the stabilizing bar (12) from the tools (3), rotating the tool (3) through 90° to align the head (9) with the slot (10), and retracting the head through the slot (10).

The tools are used by attaching a closed lifting hook (14) through each eye (6) and flexible members (15) which extend from the hooks to lifting equipment (not shown).

Figure 5:
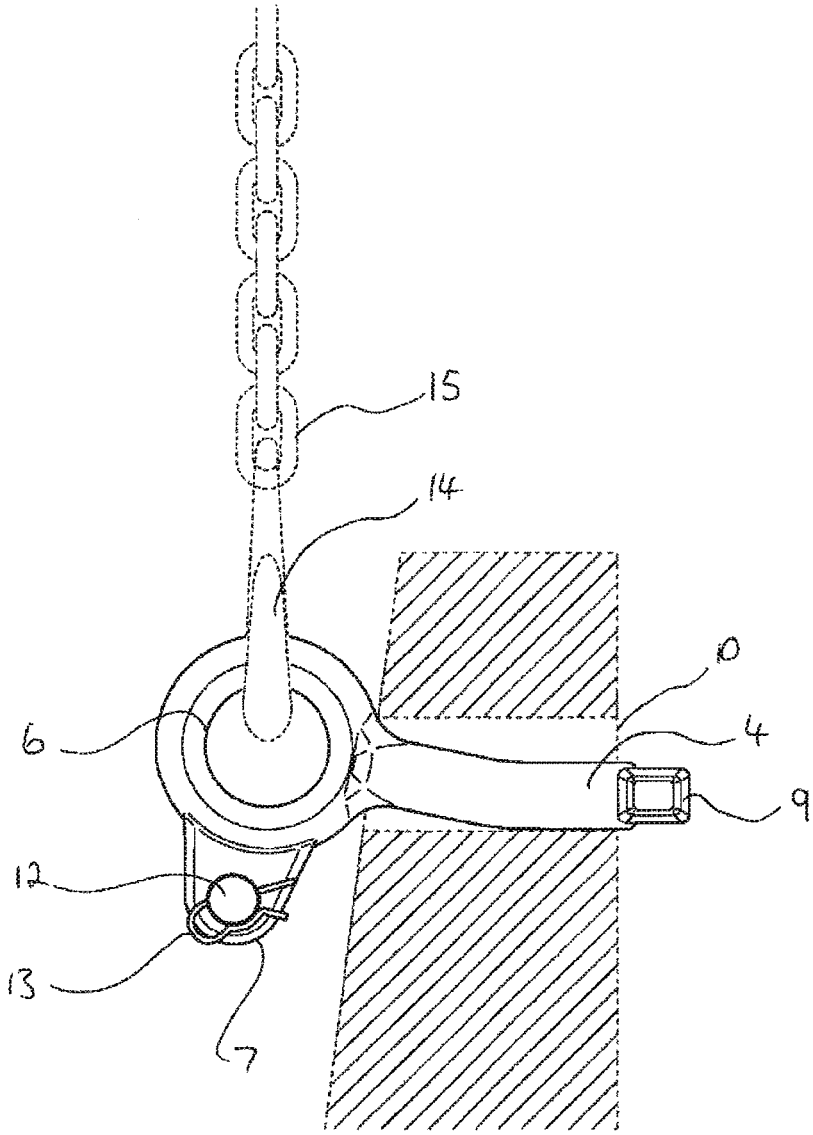
FIG. 5 shows the jaw liner being lifted using the kit.

The shank (4) includes a bend in the plane of the eye (6) between the head (9) and the eye (6) away from the lug (7). This allows the hole (8) to be located slightly forward of the corrugated surface of the jaw liner (2), which eases the insertion of the stabilizer bar (12) through the two holes (8) in the lugs (7). The bent part of the shank (4) provides firm surface engagement with the bottom of the slot (10), as shown in FIG. 5.

The assembly above described ensures that the liner jaw (2) is securely held while being lifted and manipulated into or out of its operating position in a jaw crusher.

It is also a feature of this embodiment that the lifting position of the eye (6) is such that the liner (2) when lifted orientates in an inclined position such that it will lean against the crusher jaw liner backing plate in a jaw crusher and thus enable the liner to be fitted and removed without other handling equipment being necessary for this purpose.

The slotted holes in the liner (2) enable this position to be achieved with the shanks (4) of the tools adjacent the eye (6) inclined to the plane of the liner (2).

The tool kit (1) is simple and effective. It may be used without skilled labor and the sizes of the various components will be chosen to suit the particular liner with which the kit is used.

It is to be understood that minor variation from the strict mathematical definition of geometrical terms and in this specification including its claims are to be held within the scope of the claims.

The invention claimed is:

1. A jaw crusher liner handling tool, comprising:

a lifting eye having a radially extending shank and a radially extending lug having a hole parallel to the central axis of the eye, the shank and lug extending at different radial directions from the eye, the shank having an elongate head on its end that is remote from the eye, the head having a longitudinal axis that is parallel to the axis of the eye and at a right angle to the end of the shank proximate the head.

2. The tool of claim 1, wherein the shank is curved in the plane of the eye in a direction away from the lug.

3. The tool of claim 2, further comprising a bar threadable through the hole in the lug and a retaining clip.

4. A tool kit, including a pair of tools as claimed in claim 1, each tool having a retaining clip further comprising a single bar engageable with each lug of each tool, with the clips engageable with each end of the single bar threaded through the pair of lugs of the respective tools.

* * * * *